US005903929A

United States Patent [19]

Chou

[11] Patent Number: 5,903,929

[45] Date of Patent: May 18, 1999

[54] SWIMMING GOGGLES WITH NOSE PROTECTION ARRANGEMENT

[76] Inventor: Terry Chou, No. 12, Hsin Ho Herng Road, Tainan City, Taiwan

[21] Appl. No.: 09/042,633

[22] Filed: Mar. 17, 1998

[51] Int. Cl.[6] ..... A61F 9/02; A63B 33/00; G02C 5/02

[52] U.S. Cl. ..... 2/441; 2/439; 2/445; 2/456; 2/452; D21/804

[58] Field of Search ..... 2/426, 431, 434, 2/438, 439, 440, 441, 442, 443, 445, 446, 452

[56] References Cited

U.S. PATENT DOCUMENTS 4,776,045 10/1988 Mysliwiec et al. ..... 2/426
5,706,527 1/1998 Kita et al. ..... 2/445
5,802,620 9/1998 Chiang ..... 2/439
5,802,621 9/1998 Chou ..... 2/439

*Primary Examiner*—John J. Calvert
*Assistant Examiner*—Katherine Moran
*Attorney, Agent, or Firm*—Rosenberg, Klein & Bilker

[57] ABSTRACT

A pair of swimming goggles includes two frames interconnected by a bridge member. The bridge member includes two receptacles respectively defined in two ends thereof adjacent to the frames. The bridge member further includes two first slots respectively defined in the two ends thereof and intersecting with an associated receptacle. Each frame includes a space which receives a lens and communicates with the associated receptacle. Each lens includes a tab received in the associated receptacle, wherein the tab has a second slot defined therein and aligned with an associated first slot. An engaging member includes two legs respectively extended through aligned first slots and second slots.

9 Claims, 10 Drawing Sheets

SWIMMING GOGGLES WITH NOSE PROTECTION ARRANGEMENT

BACKGROUND OF THE INVENTION

The present invention relates to swimming goggles with an arrangement for protecting the user's lose.

FIGS. 7 and 8 of the drawings illustrate a pair of typical conventional swimming goggles 1' comprising two lenses 11' of rigid material, two pad frames 12' for securely holding the lenses 11', a strap 14', and a bridge member 13'. Each pad frame 12' includes an annular groove 122' for receiving an engaging section 111' formed on an associated lens 11'. Each pad frame 12' further includes an eye-socket contact portion 121' to provide a close contact with the user's eye socket. Each lens 11' includes a first slot 113' defined in an outer side thereof through which an end of the strap 14' is wound. Each lens 11' further includes a second slot 112' defined in an inner side thereof for engaging with the bridge member 13'. The bridge member 13' includes a number of spaced ridges 131' for releasably engaging with rings (not labeled) defining the second slots 112'. As shown in FIG. 8, the bridge member 13' may be moved inwardly (e.g., by an impact to the bridge member 13') and thus cause injury to the user's nose.

FIGS. 9 and 10 illustrate another pair of conventional swimming goggles 2' which comprises two pad frames 21' with eye-socket contact portions 22', a bridge member 23', and two lenses 24' respectively received in the pad frames 21'. The bridge member 23' and the pad frames 21' as well as the eye-socket contact portions 22' are integrally formed with plastic material to avoid injury to the user's nose. Nevertheless, the appearance of the swimming goggles thus formed is not appealing. In addition, as shown in FIG. 10, when wearing the goggles, the user may feel uncomfortable as the bridge member 23' may push the user's nose when the strap is pulled. Although the bridge member may be increased in the thickness to make the user's nose comfortable, yet this aggravates the problem of not good-looking of the swimming goggles.

The present invention is intended to provide a pair of improved swimming goggles which mitigates and/or obviates the above problems.

SUMMARY OF THE INVENTION

In accordance with one aspect of the invention, a pair of swimming goggles comprises two frames and a bridge member interconnected between the frames. The bridge member includes two receptacles respectively defined in two ends thereof adjacent to the frames. The bridge member further includes two first slots respectively defined in the two ends thereof and intersecting with an associated receptacle. Each frame includes a space which receives a lens and communicates with the associated receptacle. Each lens includes a tab received in the associated receptacle, wherein the tab has a second slot defined therein and aligned with an associated first slot. An engaging member includes two legs respectively extended through aligned first slots and second slots.

The engaging member may be made of flexible rigid material to prevent deformation of the bridge member to thereby protect the user's nose. The frames, the bridge member, and the eye-socket contact portions are preferably integrally formed with plastic material. In addition, each frame is integrally formed with an extension which, in turn, has a buckle integral formed therewith, and further comprises a strap interconnected between the buckles. Further, the bridge member may include a recess for fittingly receiving the engaging member.

In accordance with another aspect of the invention, a pair of swimming goggles comprises two frames and a bridge member interconnected between the frames. The bridge member includes a recess having a bottom wall. The bridge member further includes two receptacles respectively defined in two ends thereof adjacent to the frames. Each frame includes a space which receives a lens and communicates with the receptacle. A first slot is defined in each of two ends of the bottom wall defining the recess and intersects with an associated receptacle. Each lens includes a tab received in the associated receptacle, wherein the tab has a second slot defined therein and aligned with an associated first slot. An engaging member is fittingly received in the recess of the bridge member and includes two legs respectively extended through the first slots in the bridge member and the second slots in the tabs.

Other objects, advantages, and novel features of the invention will become more apparent from the following detailed description when taken in conjunction with the accompanying drawings.

DESCRIPTION OF THE PREFERRED EMBODIMENTS

Figure 1:
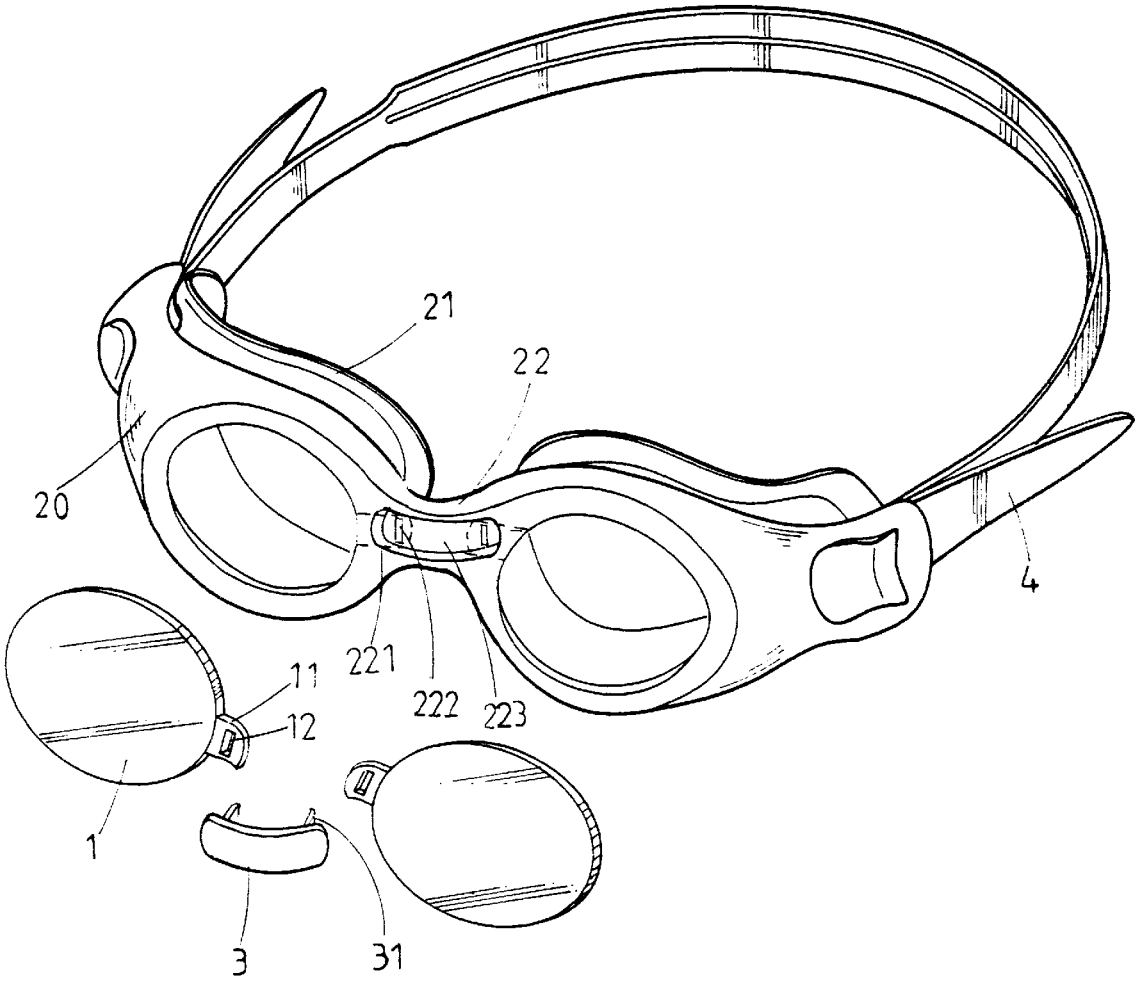
FIG. 1 is an exploded perspective view of a pair of swimming goggles in accordance with the present invention.
Figure 2:
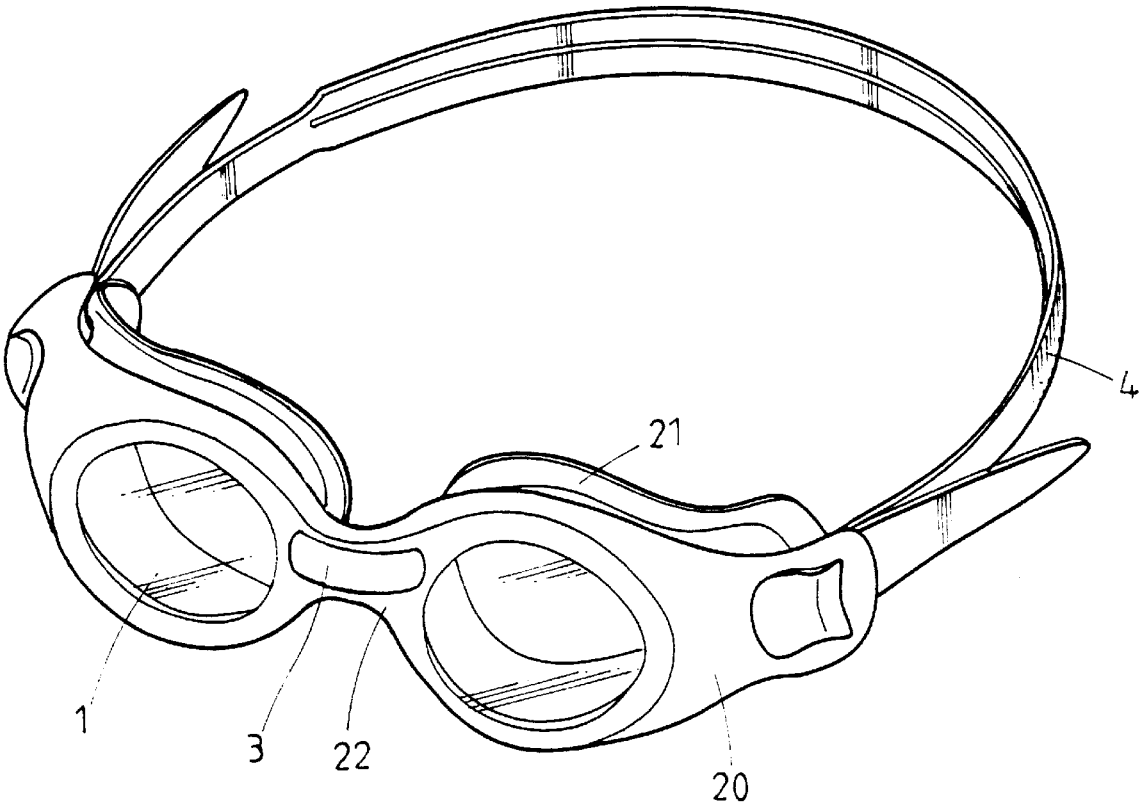
FIG. 2 is a perspective view of the swimming goggles in accordance with the present invention.
Figure 3:
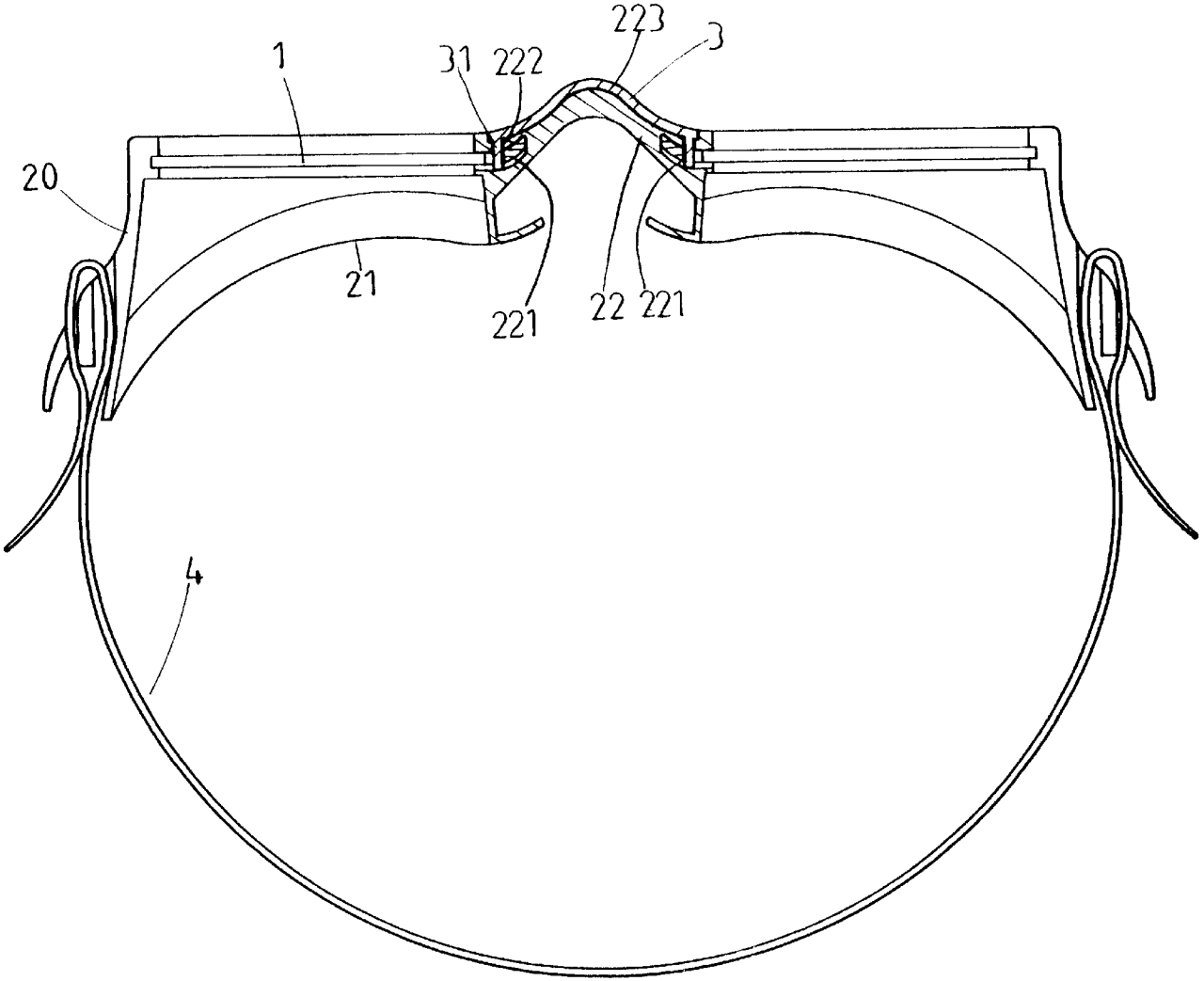
FIG. 3 is a top view, partly sectioned, of the swimming goggles in accordance with the present invention.

Referring to FIGS. 1 to 6 of the drawings and initially to FIGS. 1 to 3, a pair of swimming goggles in accordance with the present invention generally includes two frames 20 interconnected by a bridge member 22. Each frame 20 includes an eye-socket contact portion 21 formed on an interior side thereof to provide a close contact with the user's eye socket. The frames 20, the bridge member 22, and the eye-socket contact portions 21 are integrally formed with plastic material. A strap 4 is interconnected between the frames 20, which is conventional and therefore not further described.

As shown in FIGS. 1 and 3, the bridge member 22 includes a recess 223 having a bottom wall. In addition, a receptacle 221 is defined in each of two ends of the bridge member 22 adjacent to the frames 20 respectively. In addition, each frame 20 includes a spaces which receives a lens 1 and communicates with the receptacle 221. A slot 222 is defined in each of two ends of the bottom wall defining the recess 223 and intersects with an associated receptacle 221. Each lens 1 includes a tab 11 received in an associated receptacle 221, and an engaging member 3 is fittingly received in the recess 223 of the bridge member 22 and includes two legs 31 respectively extended through the slots 222 in the bridge member 22 and slots 12 which are respectively defined in the tabs 11. The engaging member 3 is preferably made of flexible rigid material and so sized as to be fittingly received in the recess 223, best shown in FIG. 3. By such an arrangement, when wearing the pair of swimming goggles and pulling the strap 4 outwardly, deformation of the bridge member 22 is prevented due to provision of the flexible rigid engaging member 3 to thereby provide the user's eye-sockets with increased comfort and close contact.

Figure 4:
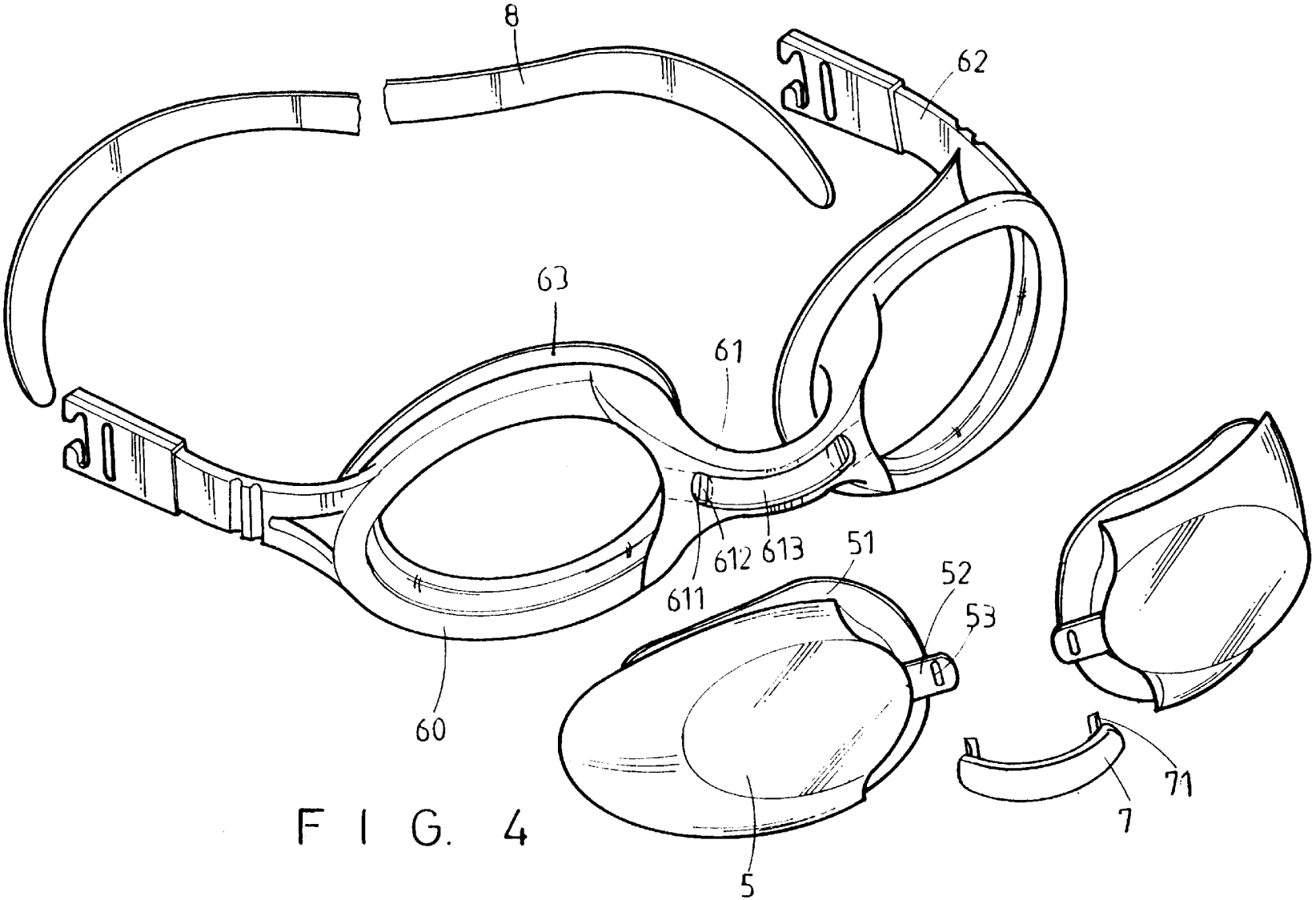
FIG. 4 is an exploded perspective view of a pair of swimming goggles of a second embodiment in accordance with the present invention.
Figure 5:
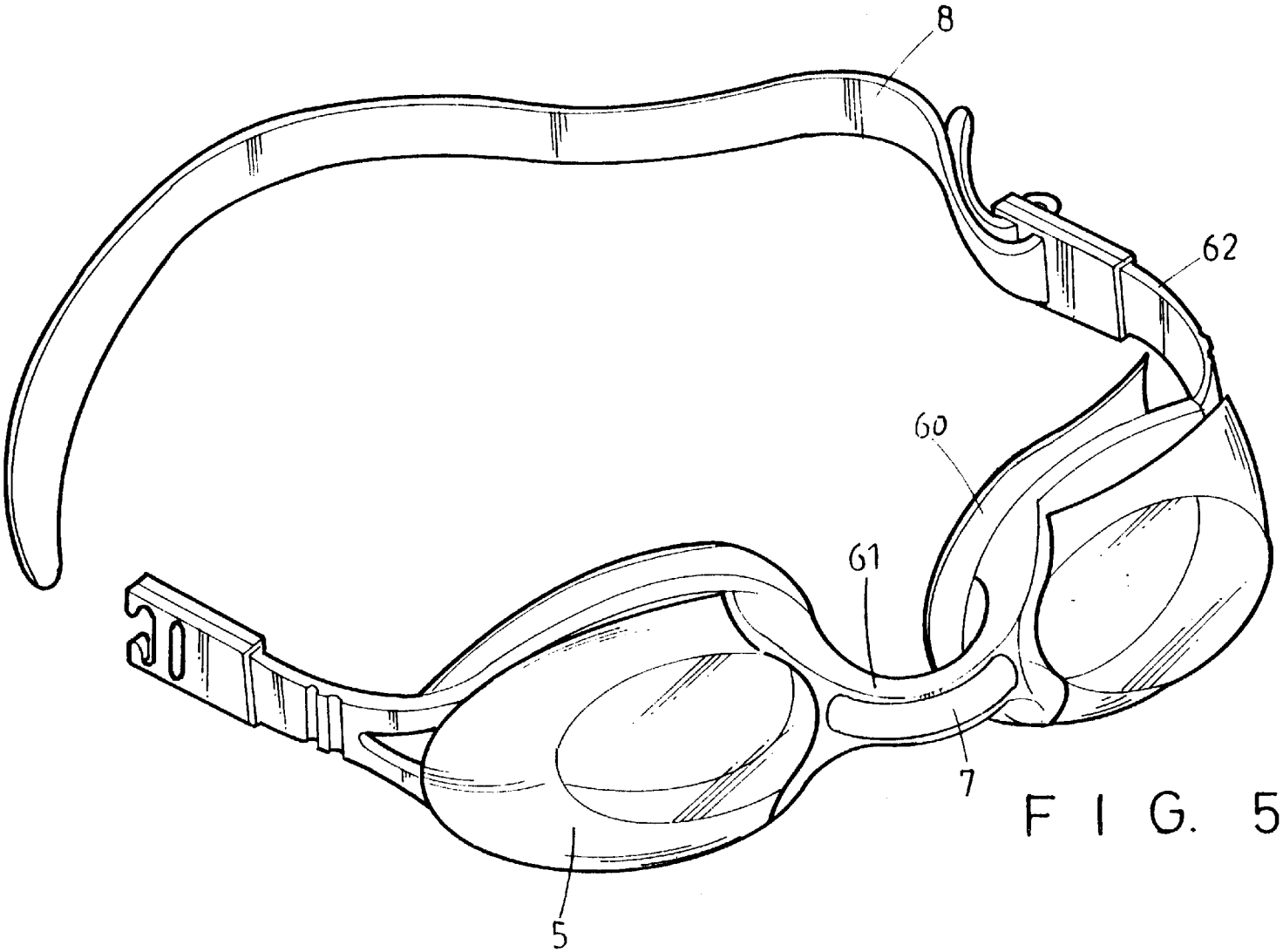
FIG. 5 is a perspective view of the swimming goggles in FIG. 4.
Figure 6:
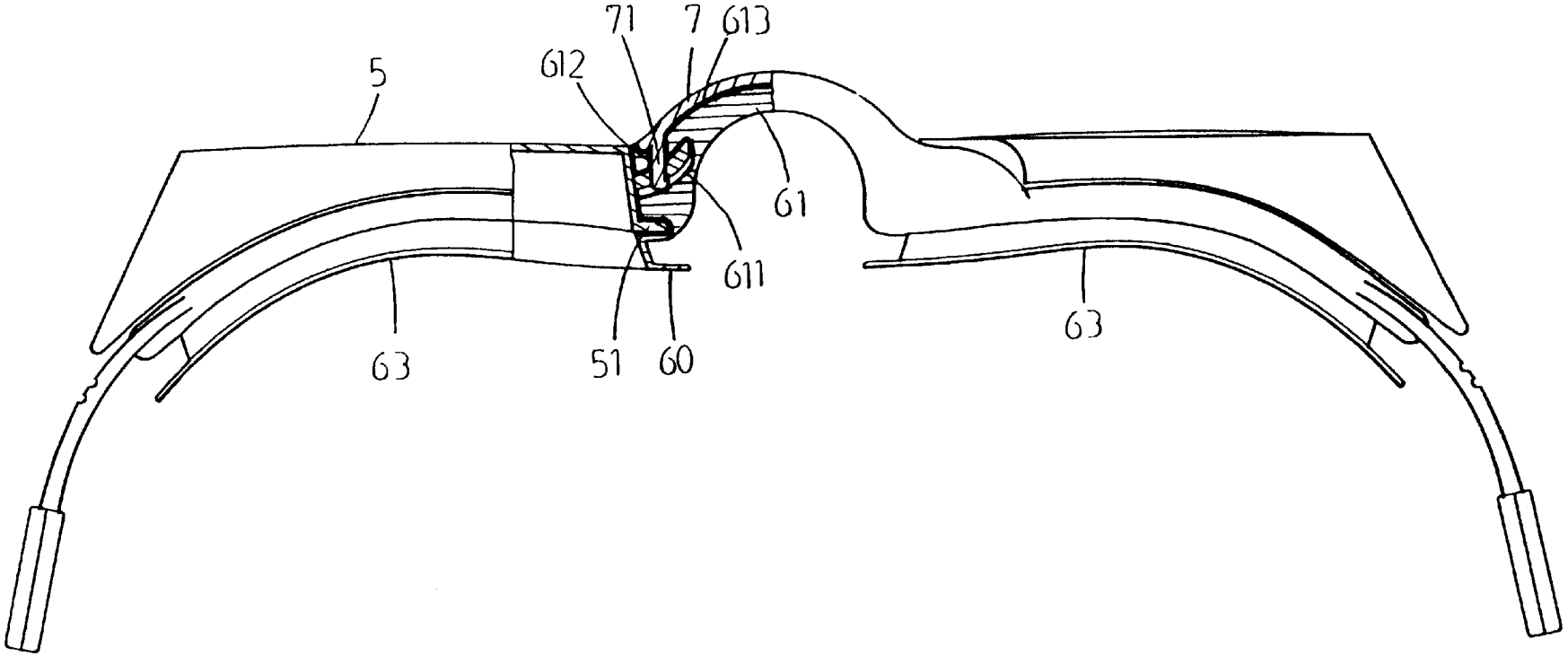
FIG. 6 is a top view, partly sectioned, of a main portion of the swimming goggles in FIG. 4.
Figure 7:
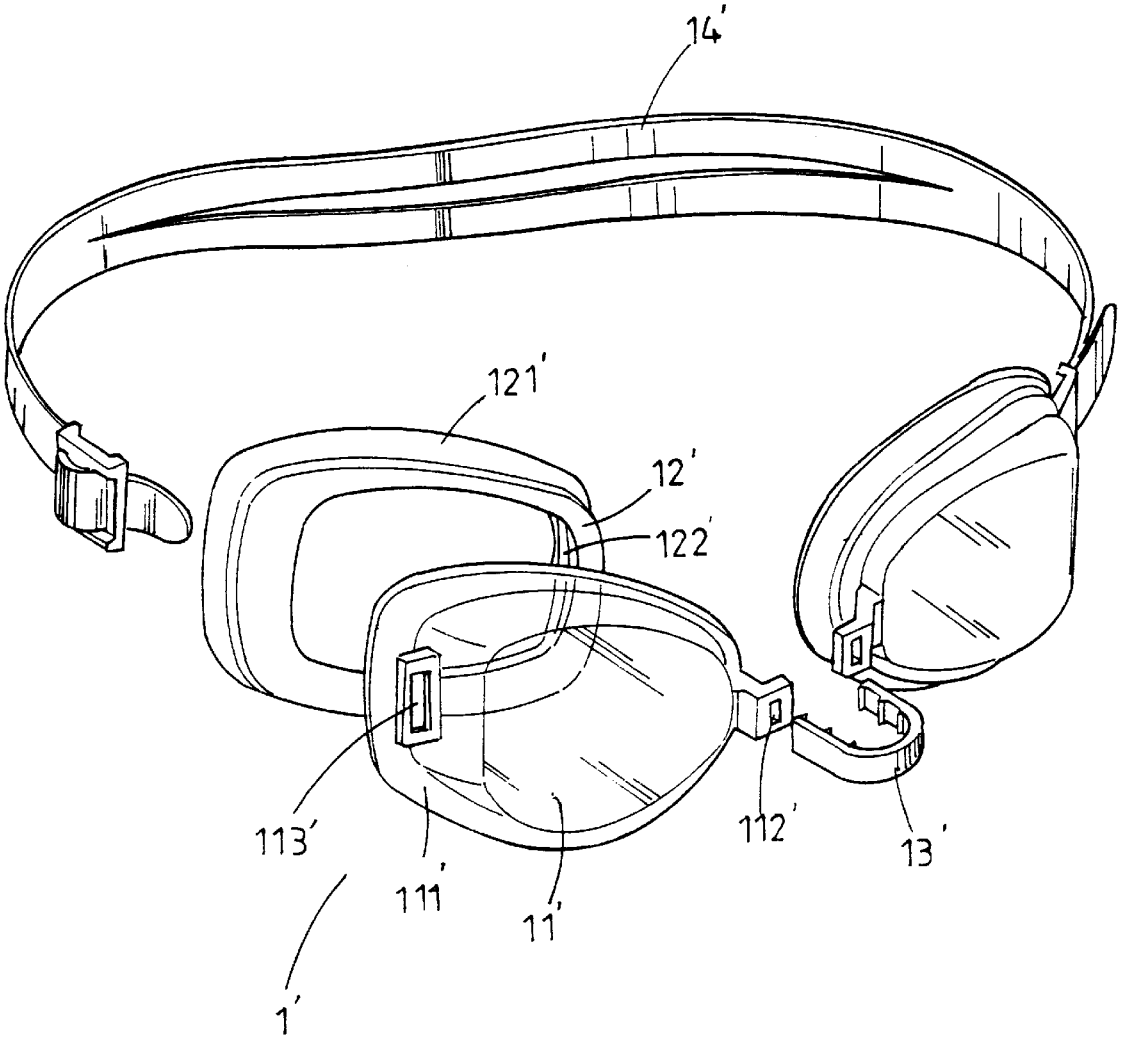
F I G. 7 PRIOR ART
FIG. 7 is an exploded perspective view of a pair of conventional swimming goggles.
Figure 8:
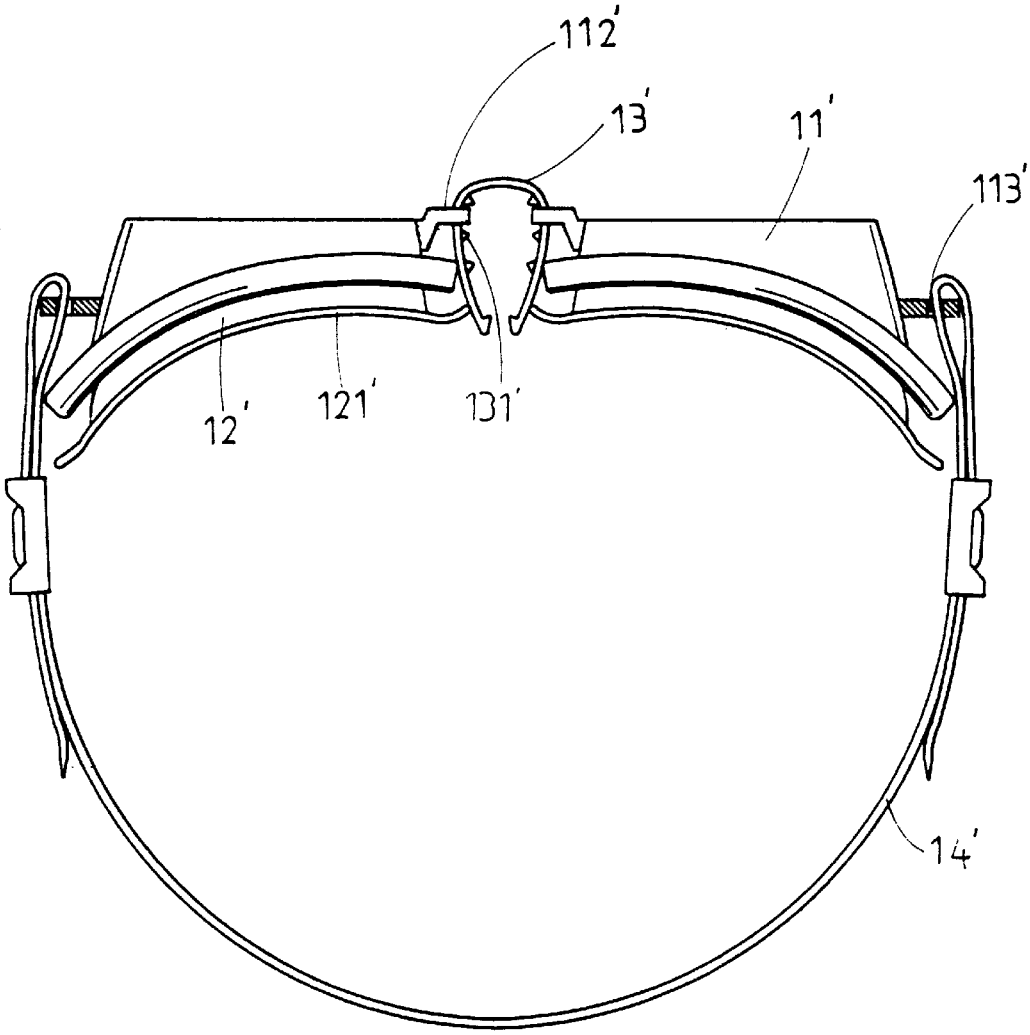
FIG. 8 PRIOR ART
FIG. 8 is a top view, partly sectioned, of the swimming goggles in FIG. 7.
Figure 9:
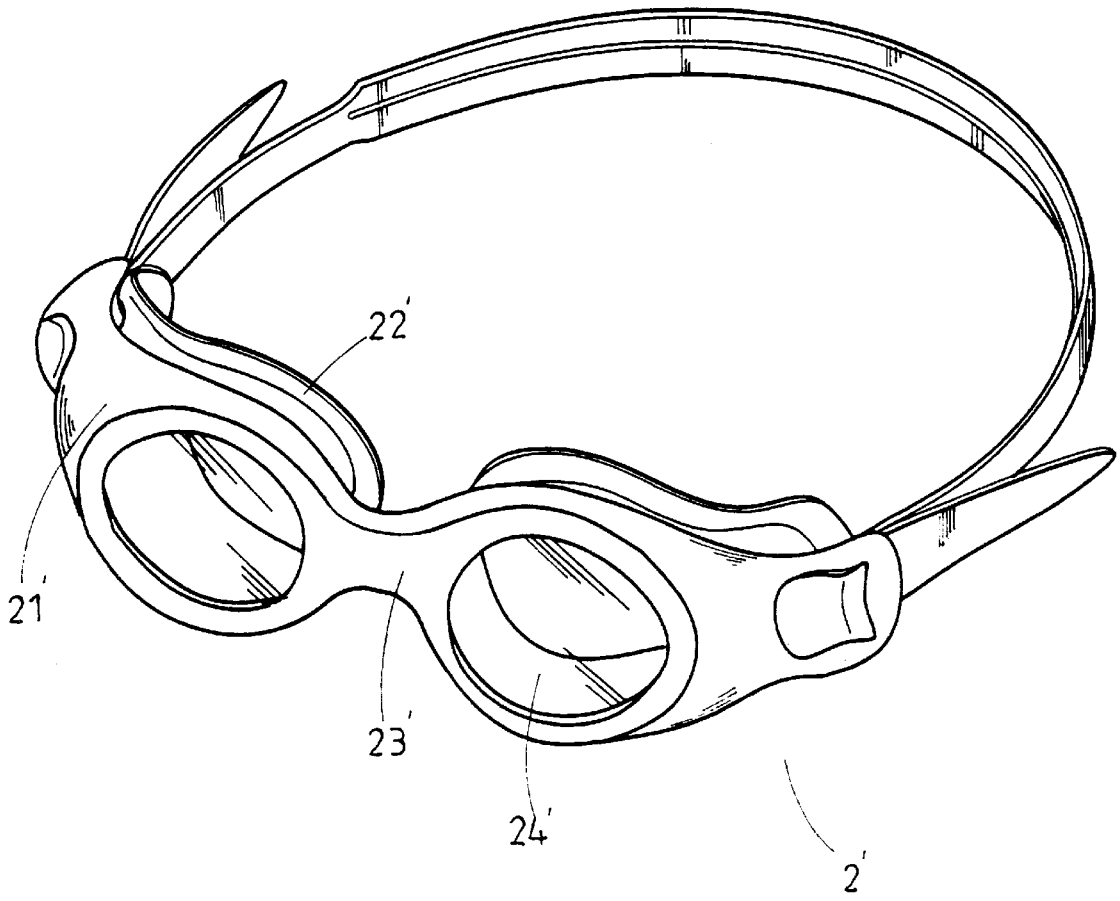
FIG. 9 PRIOR ART
FIG. 9 is a perspective view of another pair of conventional swimming goggles.
Figure 10:
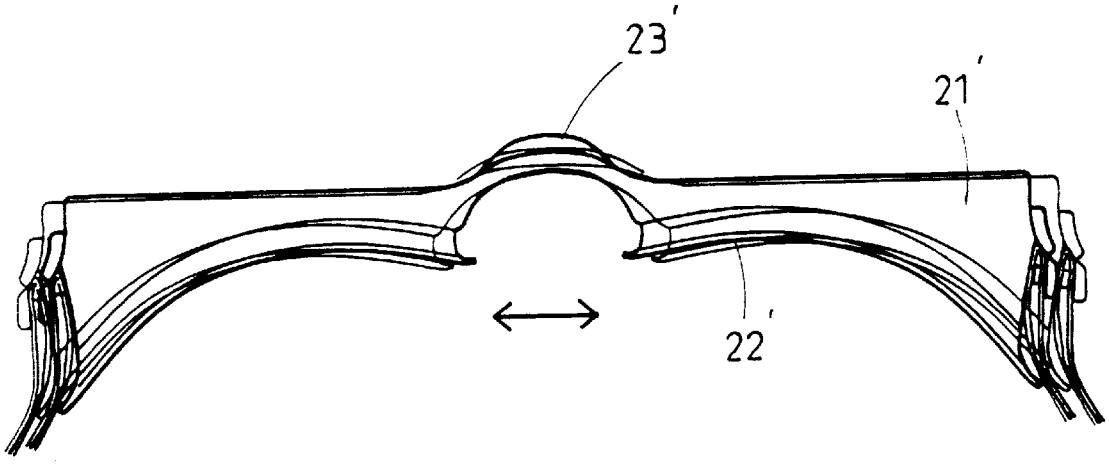
F I G. 10 PRIOR ART
FIG. 10 is a partial top view of the swimming goggles in FIG. 9.

Now refer to FIGS. 4 to 6 which illustrate a modified embodiment of the pair of swimming goggles in accordance with the present invention. The pair of swimming goggles includes two frames 60 interconnected by a bridge member 61. Each frame 60 includes an eye-socket contact portion 63 formed on an interior side thereof to provide a close contact with the user's eye socket. The frames 60, the bridge member 61, and the eye-socket contact portions 63 are integrally formed with plastic material. In addition, each frame 60 may be integrally formed with an extension 62 having a buckle (not labeled) also integral with the extension 62, and a strap 8 is interconnected between the buckles, which is conventional and therefore not further described.

As shown in FIGS. 4 and 6, the bridge member 61 includes a recess 613 having a bottom wall. In addition, a receptacle 611 is defined in each of two ends of the bridge member 61 adjacent to the frames 60, respectively. In addition, each frame 60 includes a space which receives a lens 5 and communicates with the receptacle 611. A slot 612 is defined in each of two ends of the bottom wall defining the recess 613 and intersects with an associated receptacle 611. Each lens 5 includes a tab 52 received in an associated receptacle 611, and an engaging member 7 is fittingly received in the recess 613 of the bridge member 61 and includes two legs 71 respectively extended through the slots 612 in the bridge member 61 and slots 53 which are respectively defined in the tabs 52. In this embodiment, the lens 5 includes an engaging means 51 provided therearound for engaging with the associated frame 60. The engaging member 7 is preferably made of flexible rigid material and so sized as to be fittingly received in the recess 613, best shown in FIG. 6. Again, by such an arrangement, when wearing the pair of swimming goggles and pulling the strap 8 outwardly, deformation of the bridge member 61 is prevented due to provision of the flexible rigid engaging member 7 to thereby provide the user's eye-sockets with increased comfort and close contact.

Although the invention has been explained in relation to its preferred embodiment, it is to be understood that many other possible modifications and variations can be made without departing from the spirit and scope of the invention as hereinafter claimed.

What is claimed is:

1. A pair of swimming goggles, comprising:

two frames and a bridge member interconnected between the frames, the bridge member including two receptacles respectively defined in two ends thereof adjacent to the frames, the bridge member further including two first slots respectively defined in the two ends thereof and intersecting with an associated said receptacle, each said frame including a space which receives a lens and communicates with the associated receptacle, each said lens including a tab received in the associated receptacle, said tab having a second slot defined therein and aligned with an associated said first slot, and an engaging member including two legs respectively extended through aligned said first slots and said second slots.

2. The swimming goggles according to claim 1, wherein the engaging member is made of flexible rigid material.

3. The swimming goggles according to claim 1, wherein the frames, the bridge member, and the eye-socket contact portions are integrally formed with plastic material.

4. The swimming goggles according to claim 3, each said frame is integrally formed with an extension which, in turn, has a buckle integral formed therewith, and further comprises a strap interconnected between the buckles.

5. The swimming goggles according to claim 1, wherein the bridge member includes a recess for fittingly receiving the engaging member.

6. A pair of swimming goggles, comprising:

two frames and a bridge member interconnected between the frames, the bridge member including a recess having a bottom wall, the bridge member further including two receptacles respectively defined in two ends thereof adjacent to the frames, each said frame including a space which receives a lens and communicates with the receptacle, a first slot being defined in each of two ends of the bottom wall defining the recess and intersecting with an associated said receptacle, each said lens including a tab received in the associated receptacle, said tab having a second slot defined therein and aligned with an associated said first slot, and an engaging member being fittingly received in the recess of the bridge member and including two legs respectively extended through the first slots in the bridge member and the second slots in the tabs.

7. The swimming goggles according to claim 6, wherein the engaging member is made of flexible rigid material.

8. The swimming goggles according to claim 6, wherein the frames, the bridge member, and the eye-socket contact portions are integrally formed with plastic material.

9. The swimming goggles according to claim 8, each said frame is integrally formed with an extension which, in turn, has a buckle integral formed therewith, and further comprises a strap interconnected between the buckles.

* * * * *